US008893924B2

(12) United States Patent
Cash et al.

(10) Patent No.: US 8,893,924 B2
(45) Date of Patent: Nov. 25, 2014

(54) STACKABLE CONTAINER FOR STORING AND/OR DISPENSING LIQUIDS

(75) Inventors: Warren Cash, South Pambula (AU); Andrew Cash, South Pambula (AU)

(73) Assignee: Anthony B. Michellutti, Panania (AU)

( * ) Notice: Subject to any disclaimer, the term of this patent is extended or adjusted under 35 U.S.C. 154(b) by 515 days.

(21) Appl. No.: 11/738,008

(22) Filed: Apr. 20, 2007

(65) Prior Publication Data

US 2007/0246488 A1 Oct. 25, 2007

(30) Foreign Application Priority Data

Apr. 20, 2006 (AU) ..... 2006902041

(51) Int. Cl.
*B67D 7/78* (2010.01)
*B65D 1/20* (2006.01)
*B65D 23/10* (2006.01)

(52) U.S. Cl.
CPC . *B65D 1/20* (2013.01); *B65D 23/10* (2013.01)
USPC ..... 222/143; 222/210; 222/466; 206/509; 383/32

(58) Field of Classification Search
USPC ..... 222/143, 466, 206, 92–107, 191, 210, 222/465.1; 206/503–504, 507–512; 215/10, 215/398; 383/32, 120
See application file for complete search history.

(56) References Cited

U.S. PATENT DOCUMENTS

| | | | | | |
|---|---|---|---|---|---|
| 3,176,879 | A * | 4/1965 | Mojonnier | 222/143 |
| 3,323,668 | A * | 6/1967 | Hills | 215/10 |
| 3,391,824 | A * | 7/1968 | Wiseman | 206/504 |
| 3,547,309 | A * | 12/1970 | Pusey et al. | 206/504 |
| 3,886,751 | A * | 6/1975 | Porraz Jimenez Labora | 405/107 |
| D282,957 | S * | 3/1986 | Carlson | D23/212 |
| 4,656,840 | A * | 4/1987 | Loofbourrow et al. | 62/530 |
| 4,775,564 | A * | 10/1988 | Shriver et al. | 428/36.92 |
| 4,805,793 | A * | 2/1989 | Brandt et al. | 215/10 |
| 4,805,808 | A * | 2/1989 | Larson | 222/185.1 |
| 4,911,562 | A * | 3/1990 | Mazzeschi | 383/16 |
| 4,928,860 | A * | 5/1990 | Knight | 222/466 |
| 5,064,101 | A * | 11/1991 | Richter et al. | 222/143 |
| 5,105,858 | A * | 4/1992 | Levinson | 141/2 |
| 5,452,803 | A * | 9/1995 | Stromberg | 206/507 |
| 5,967,322 | A * | 10/1999 | Apps et al. | 206/497 |
| 6,050,455 | A * | 4/2000 | Soehnlen et al. | 222/185.1 |
| 6,471,402 | B1 * | 10/2002 | Burns | 383/32 |
| D466,413 | S * | 12/2002 | Justice | D9/531 |
| 6,772,912 | B1 * | 8/2004 | Schall et al. | 222/143 |
| 6,935,533 | B2 * | 8/2005 | Clausen et al. | 222/143 |
| 7,182,214 | B2 * | 2/2007 | Darr et al. | 215/398 |
| 2004/0056053 | A1 * | 3/2004 | Hollander et al. | 222/466 |

* cited by examiner

*Primary Examiner* — J. Casimer Jacyna
*Assistant Examiner* — Andrew P Bainbridge
(74) *Attorney, Agent, or Firm* — Jennifer S. Stachniak; Robert W. Becker

(57) ABSTRACT

A container for storing and/or dispensing liquid includes a body portion having a neck portion with an opening, at least one protrusion and at least one recessed portion, so that the container can utilize internal liquid pressure to provide strength for the container, so that less material is required for supporting the shape and structure of the container and so that the use of external packaging can be avoided.

16 Claims, 2 Drawing Sheets

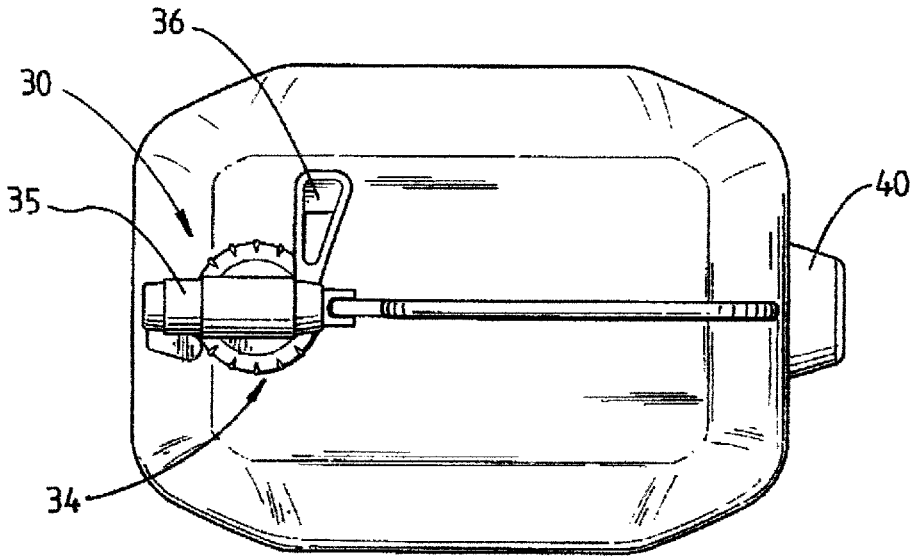
FIG. 3
FIG. 4
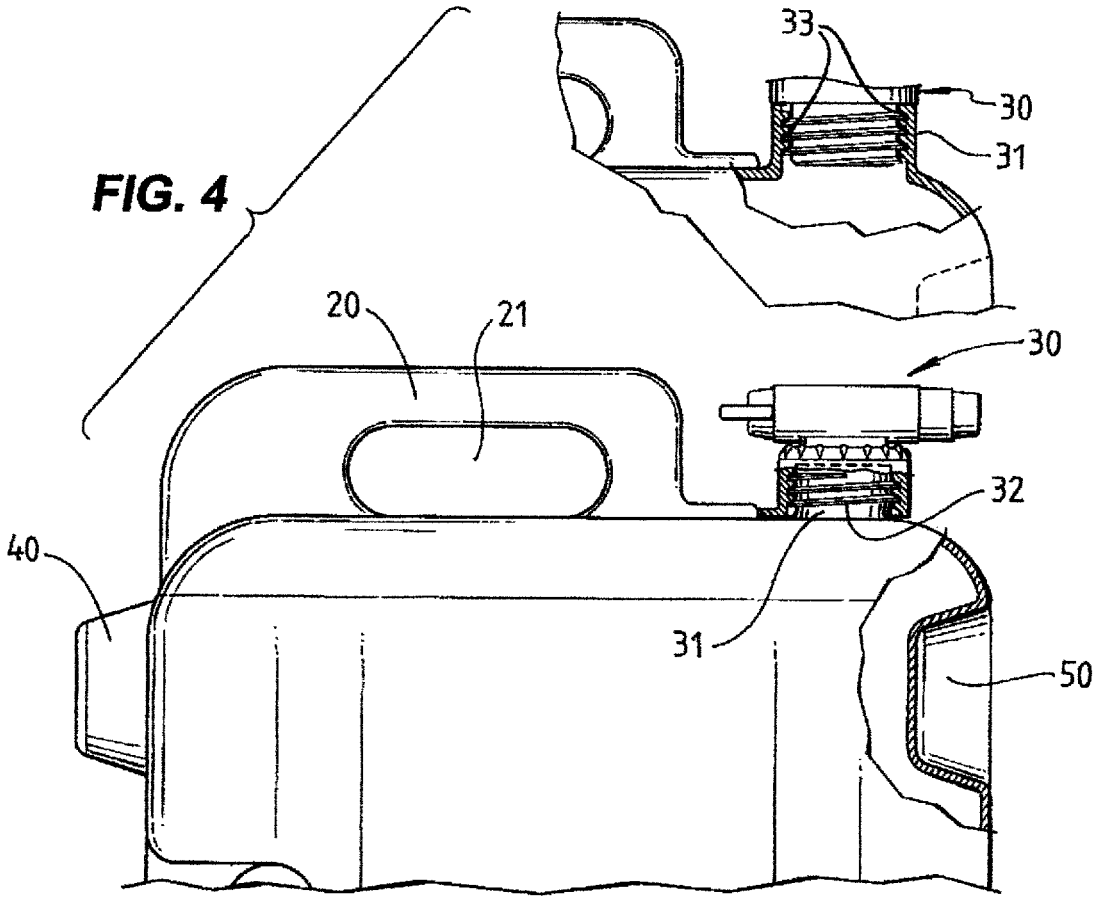

STACKABLE CONTAINER FOR STORING AND/OR DISPENSING LIQUIDS

FIELD OF THE INVENTION

The invention relates to the area of packaging, and in particular, to a container for storing and/or dispensing liquid which is adapted to utilise internal liquid pressure to provide strength for the container thus, requiring less material and avoiding the necessity for external packaging.

Whilst the invention can be applied to any liquid filled container, for convenience sake it shall be described herein in terms of a self-dispensing container for liquid.

BACKGROUND TO THE INVENTION

The use of self-dispensing water containers has become a common widely-adopted alternative to the use of water dispensing machines with bottled water. These containers are generally in the form of a semi-rigid packaging made of a synthetic material such as PET (polyethylene-terephthalate), PP (polypropylene), HDPE (high-density polyethylene) etc. The disadvantage with these materials is that the mechanical strength provided is fairly low relative to the amount of synthetic material required to make a container.

Accordingly, current containers or bottles are made having significantly thicker walls and/or reinforcing structures such as bulges, stiffening ridges or the like. The inability to fill a container almost completely also requires that more material is utilized in order to provide reinforcement for the bottle. Unfortunately, these features result in the increase of weight of the containers, and the amount of material required and complexity of the design increases the cost of manufacture of the containers. In addition, due to the rigidity of the container, once the container is empty, it remains bulky and is difficult to crush and dispose of the container for waste or recycling.

Due to the lack of mechanical and/or hydraulic/internal strength of current containers, the containers often require the use of additional external packing or support structures or extra materials particularly during transport or storage in supermarket shelves or within a home or building to keep the containers securely stored.

It is an object of the present invention to overcome or substantially ameliorate the disadvantages of the prior art by providing a stackable container for storing and/or dispensing liquid which provides a means for using less plastic and eliminating the requirement of external packaging by utilising internal liquid pressure to provide strength for the container.

SUMMARY OF THE INVENTION

The present invention provides a container for storing and/or dispensing liquid including:

a body portion having a neck portion with an opening;

at least one protrusion; and at least one recessed portion whereby the container is adapted to utilise internal liquid pressure to provide strength for the container thus, requiring less material and avoiding the necessity for external packaging.

It is further preferred that the container preferably has provided at least one handle.

The container is preferably a self-dispensing container and is preferably substantially rectangular and rounded or barrel shaped to assist the internal liquid pressure to be evenly distributed throughout the container when full, in order to provide compressive strength and stability to said container.

A first handle is preferably integrally formed with the top portion of the body portion of the container and provides a first carrying means for enabling a person to lift and carry the portable container in a horizontal position. The first handle is preferably formed such that it forms a part of the top portion of the body portion. Preferably, the first handle has provided an aperture located between the underside of the handle and the body portion of the container which is adapted to enable a user to wrap their fingers around the handle and obtain a sufficient grip of the handle.

A second handle is integrally formed with a first side of the container and provides a second carrying means for enabling a person to lift and carry the portable container in a vertical position. The second handle preferably has an inverted u-shape whereby the open ends of the u-shape, are adapted to be integrally formed with the surface of a first side of the container so that the handle extends outwardly from the side of the container. Preferably, the second handle has provided an aperture located between the handle and the side of the body portion of the container which is adapted to enable a user to wrap their fingers around the handle and obtain a sufficient grip of the handle.

It is preferred that the second handle is adapted to extend outwardly from the container to a point which is the same or more than the protrusion of a dispensing means.

A base of the neck portion is adapted to be integrally formed with a first side of the body portion of the container. The neck portion is preferably circular in shape and is adapted to have provided a threaded portion provided on the outer surface of the neck portion which is adapted to receive, and be engageable with, a dispensing means connected thereto.

It is preferred that the container has a dispensing means preferably in the form of a spigot which is adapted to not only provide a seal for the container when in a closed position, but also provide a means for dispensing the liquid from the container when in an open position. The spigot preferably has a connection portion which is adapted to be connected to the neck portion of the container, a fluid passageway for dispensing the liquid from the container and a valve which is adapted to control the rate of liquid flow through the conduit and dispensing means.

Preferably, the container has provided two protrusions which are adapted to extending outwardly from the edge of the top portion of the body portion of the container. The protrusions are preferably adapted to be integrally formed with the top portion such that they form part of the top portion of the body portion of the container and liquid is able to be received therein to provide internal liquid pressure and strength to the protrusions.

It is further preferred that the container has provided two recessed portions which are adapted to be integrally formed with the bottom portion of the body portion of the container and extend inwardly toward the centre of the container. The two recessed portions are preferably adapted to be positioned such that they correspond to the positioning of the protrusions, and are complimentary in shape to the protrusions, so that the protrusions can be received within the recessed portions.

In order that the invention may be more readily understood we will describe by way of non-limiting example of a specific embodiment thereof.

BRIEF DESCRIPTION OF THE DRAWING FIGURES

FIG. 3 shows a top plan view of the container according to a preferred embodiment of the invention.

FIG. 4 shows a side view of a first side of the container according to a preferred embodiment of the invention.

DESCRIPTION OF A PREFERRED EMBODIMENT OF THE INVENTION

Figure 2:
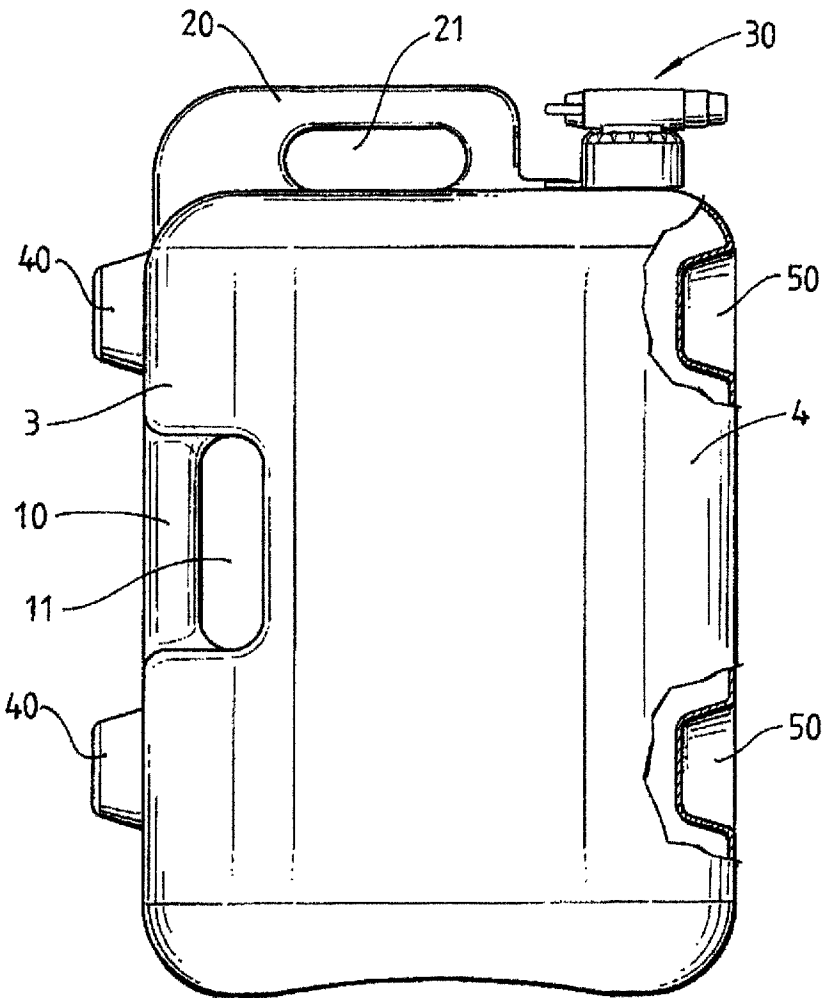
FIG. 2 shows a side view of the container according to a preferred embodiment of the invention.
Figure 1:
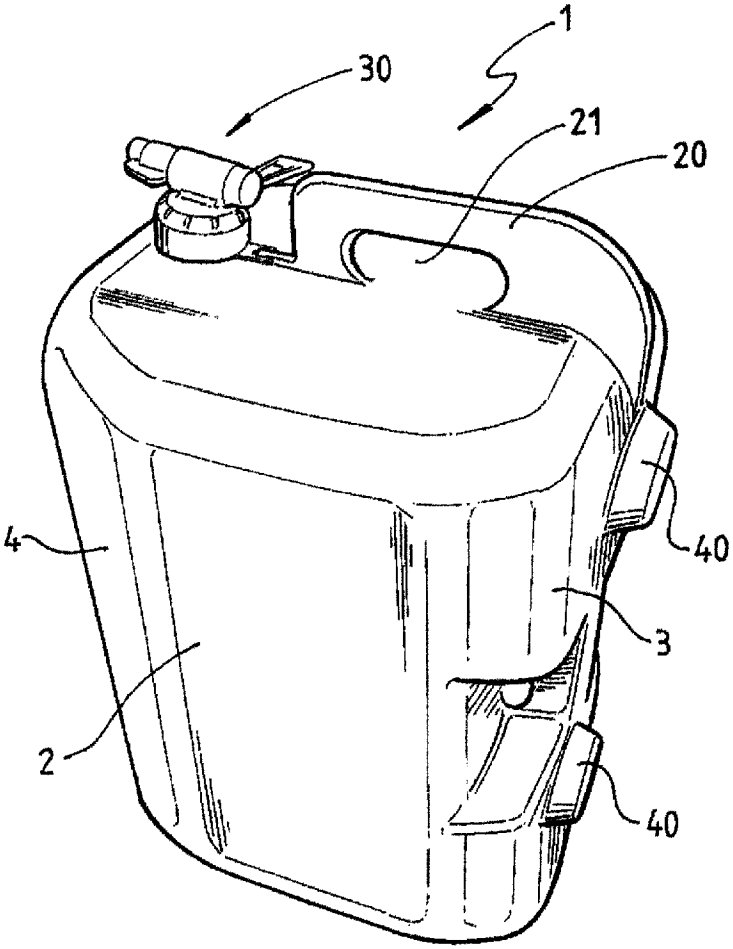
FIG. 1 shows a perspective view of the container according to a preferred embodiment of the invention.

In this preferred embodiment, the invention provides a container 1 for storing and/or dispensing liquid which is adapted to utilise internal liquid pressure to provide strength for the container 1 thus, requiring less material and avoiding the necessity for external packaging. In a preferred embodiment, the container 1 is preferably a self-dispensing container 1 which is adapted to store and/or dispense a liquid from inside the container 1. It is envisaged that the shape, style and dimensions of the container 1 may be varied as desired to suit different liquids, quantities and/or applications.

The container 1 has provided a body portion 2 which is preferably made of a lightweight plastics material such that, when the container is completely full, the container 1 will be relatively light in weight and easy to handle depending on the capacity of the container 1. Similarly, it is envisaged that a synthetic material and/or any other suitable material may also be adopted as desired. It is envisaged that the grade of material may also be varied depending on the strength required by the container 1.

The body portion 2 of the container 1 is preferably substantially rectangular in shape. The shape may also be rounded or barrel shaped so that it is adapted to assist the internal liquid pressure to be evenly distributed throughout the body 2 of the container 1 when full, in order to provide compressive strength and stability to the container 1. The rectangular rounded or barrel shape also provides a convenient shape for enabling two or more containers 1 to be stacked on top of one another and/or adjacent to one another. It is envisaged that the container 1 could also be in the form of any other suitable shape, size or dimensions provided that the functionality and requirements prescribed by the invention are met.

The container 1 preferably has at least one handle which is adapted to make the container 1 portable and enable a user to carry the container 1. A first handle 10 may preferably be provided on a top portion 3 of the body portion 2 of the container 1. The first handle 10 is preferably integrally formed with the top portion 3 of the container 1 and provides a first carrying means for enabling a person to lift and carry the portable container 1 in a horizontal position. In a preferred embodiment, the first handle 10 is preferably formed such that it forms a part of the top portion 3 of the body portion 2. The top portion 3 of the body portion 2 preferably has a u-shape extending toward to the centre of the body portion 2 with the handle 20 bridging across the top of the open ends of the u-shape. It is envisaged however, that the first handle 10 may also be provided separately and be attached to the container 1 via any other suitable securing or fastening means. The first handle 10 preferably has provided an aperture 11 located between the underside of the handle 10 and the body portion 2 of the container 1 which is adapted to enable a user to wrap their fingers around the handle 10 and obtain a sufficient grip of the handle. The width of the handle 10 may vary depending on the capacity of the container 1 and the strength/support required by the handle 10. The handle 10 is preferably positioned centrally on the top portion 3 of the body portion 2 of the container 1 such that the weight of the container 1 is distributed evenly about the handle 10, and is positioned such that the top of the handle 10 is in line with, or slightly lower than, the top edge of the container 1 to provide stability for the container 1 when two or more containers 1 are stacked on top of one another.

A second handle 20 is preferably provided on a first side of the body portion 2 of the container 1. The second handle 20 is preferably integrally formed with the container and provides a second carrying means for enabling a person to lift and carry the portable container in a vertical position. It is envisaged however, that the second handle 20 may also be attached to the container 1 via any other suitable securing and/or fastening means. In a preferred embodiment, the handle 20 has an inverted u-shape whereby the open ends of the u-shape, are adapted to be integrally formed with the surface of the side of the container 1 so that the handle 20 extends outwardly from the side of the container 1. The handle 10 is preferably substantially flat. However, the thickness and/or material should be such that shape it is able to suit the capacity of, and provide the appropriate degree of strength required by, the container 1. The second handle 20 preferably has provided an aperture 21 located between the handle 21 and the side of the body portion 2 of the container 1 which is adapted to enable a user to wrap their fingers around the handle 20 and obtain a sufficient grip of the handle 20. The handle 20 is preferably positioned on the side of the top portion 3 of the body portion 2 of the container 1 to allow for a dispensing means 30 to be located on the bottom portion 4 of the side of the body portion 2 of the container 1 adjacent to the second handle 20. The handle 20 is preferably adapted to extend outwardly from the container 1 to a point which is the same or more than the protrusion of the dispensing means 30 so that, when the container 1 is kept on its bottom surface, the second handle 20 will provide protection for the dispensing means 30 from being accidentally knocked and/or damaged. The second handle 20 is preferably adapted to fit and lie within a complimentary ridge provided on a second opposing side of the body portion 2 of the container 1 to provide stability during stacking and/or support when the container 1 is empty. In an alternate embodiment it is envisaged that a handle may not be provided.

Provided on the bottom portion 4 of the first side of the body portion 2 of the container 1, adjacent to the second handle 20, is preferably a hollow neck portion 31 which is adapted to provide a conduit for enabling liquid to enter or exit the container. The base of the neck portion 31 is preferably adapted to be integrally formed with the side of the body portion 2 of the container 1 and is located adjacent to the second handle 20 of the container 1. The neck portion 31 is preferably circular in shape and is adapted to have provided a threaded portion 32 provided on the outer surface of the neck portion 31 which is adapted to receive, and be engageable with, a dispensing means 30 connected thereto. In an alternate embodiment, the threaded portion 33 may be provided on the inner wall of the neck portion to suit a different dispensing means 30. Accordingly, it is envisaged that the size and style of the neck portion may be varied to suit a different dispensing means 30 that can be used in conjunction with the container.

The invention preferably has provided a dispensing means 30. The dispensing means 30 is preferably in the form of a spigot which is adapted to not only provide a seal for the container when in a closed position, but also provide a means for dispensing the liquid from the container 1 when in an open position. The spigot 30 preferably has provided a connection portion 34 which is adapted to be connected to the neck portion 31 of the container 1 and allow liquid to flow through the neck portion 31 and outwardly from the spigot 30. The connection portion 34 preferably has a complimentary shape to the neck portion 31 and may preferably have provided an aperture and a threaded portion (not shown) which is complimentary in shape to the threaded portion (not shown) provided on the neck portion 31 of the container 1 such that it is adapted to be received and engageable with the neck portion 31 of the container 1. The spigot 30 preferably includes a fluid passageway 35 for dispensing the liquid from the container 1. The spigot 30 preferably has provided a valve 36 or any other suitable means which is adapted to control the rate of water flow through the conduit and dispensing means 30 of the container 1. The dispensing means 30 can preferably be removed for filling of the container 1. In a further embodiment of the invention, it is envisaged that a cap for filling the container with liquid may be provided separately to the dispensing means 30 of the invention. It is further envisaged that any other suitable dispensing means may be provided for the container or be eliminated for non-dispensing containers.

The container 1 of the invention preferably has provided at least one protrusion 40 and at least one recessed portion 50 which are adapted to provide a means for enabling the container to be stackable and connected with another same container which is positioned adjacently. In a preferred embodiment, the container 1 has two protrusions 40 which are adapted to extend outwardly from the edge of the top portion 3 of the body portion 2 of the container 1. The two protrusions 40 are preferably positioned on either side of the handle 10. The protrusions are preferably adapted to be integrally formed with the top portion such that they form part of the top portion 3 of the body portion 2 of the container and liquid is able to be received therein to provide internal liquid pressure and strength to the protrusions 40. In an alternate embodiment, the protrusions 40 may be in the form of any other suitable connection means which may be integrally formed with or separately secured to the container 1. In an alternate embodiment, it is envisaged that the water may not pass through the protrusions.

In a preferred embodiment, the container 1 has two recessed portions 50. The recessed portions 50 are adapted to be integrally formed with the bottom portion 4 of the body portion 2 of the container 1 and extend inwardly toward the centre of the container 1. The two recessed portions 50 are preferably adapted to be positioned such that they correspond to the positioning of the protrusions 40 provided on the top portion 3 of the body portion 2 of the container 1. The recessed portions 50 are preferably adapted to be complimentary in shape to the protrusions 40 so that the protrusions 40 can be received within the recessed portions 50. When the containers 1 are horizontally stacked, the outwardly extending portions of a first container are received and connected within the recessed portions 50 provided on a second container (not shown) placed on top of the first container to provide stability for the stacked containers.

In practice, the container 1 is placed in a vertical position and a nozzle connected to a water/liquid supply is inserted into the container 1 via an open neck portion 31 of the container 1. The container 1 is then filled with water/liquid until the water/liquid fills the container 1 right up to the flat side surface and up through the neck portion 31 of the container 1 leaving only a tiny air bubble remaining, as complete eradication of such a bubble would require filling and sealing of the container under water thus, the container 1 of the invention is able to be filled up to 99.5% of the container's volume unlike current containers which are only capable of being filled up to approximately 95% of the total volume of the container 1. When the container is completely full, the water/liquid molecules will be evenly distributed throughout the container 1 and the internal pressure of water/liquid molecules inside will provide compressive strength and stability for the container 1 to maintain its shape without the need for the use of excessive amounts of material to make the container 1, and eliminating the need for external packaging and/or support the container 1.

While we have described herein a particular embodiment of the container 1, it is further envisaged that other embodiments of the invention could exhibit any number and combination of any one of the features previously described. However, it is to be understood that any variations and modifications can be made without departing from the spirit and scope thereof.

What is claimed is:

1. A stackable container for storing and dispensing liquids, comprising:

a body portion having a hollow interior, wherein said body portion has no pleats and further comprises: a bottom portion, as viewed in a first position in which said bottom portion rests upon a surface; a top portion disposed opposite said bottom portion; and a first side portion disposed between said top portion and said bottom portion;

a single hollow neck portion for both receiving and dispensing liquid, wherein said neck portion is disposed on said first side portion of said body portion adjacent to said bottom portion and in fluid communication with said hollow interior of said body portion;

a first handle disposed on said top portion, wherein no part of said first handle extends outwardly beyond an outer surface of said top portion;

a second handle extending outwardly from said first side portion and disposed between said neck portion and said top portion;

a dispensing means connectable to, and removable from, said neck portion, wherein said dispensing means is configured to receive liquid from said neck portion for dispensing such liquid, and wherein no part of said dispensing means extends outwardly from said neck portion beyond an outermost part of said second handle;

A first outwardly closed protrusion extending outwardly from said outer surface of either one of said top portion or said bottom portion, wherein said first protrusion forms a line of symmetry to said first handle; and A second outwardly closed protrusion located on the same said outer surface as said first outwardly closed protrusion, Wherein at least two closed recesses extend inwardly from said outer surface of either one of said top portion or said bottom portion, Wherein when said at least one of the at least two said closed recesses and said at least one of said first closed protrusion or said second closed protrusion are engaged, said stackable container is retained into position with a first further identically shaped stackable container in at least three different directions with respect to one another, Wherein said stackable container is selectively engaged to said first further identically shaped stackable container and to a second further identically shaped stackable container, Wherein when said stackable container is engaged with said first further identically shaped stackable container and said second further identically shaped stackable container, said first further identically shaped container is selectively oriented to be parallel with said stackable container's said line of symmetry and said second further identically shaped stackable container is selectively oriented to be perpendicular with said stackable container's said line of symmetry, Wherein when said liquid is filled into said stackable container, said liquid is in direct contact with said body portion.

2. The stackable container for storing and dispensing liquids according to claim 1, wherein said first handle has an aperture located between an underside of said handle and said body portion for enabling a person to wrap their fingers around said handle for obtaining a sufficient grip of said handle.

3. The stackable container for storing and dispensing liquids according to claim 1, wherein said second handle has an inverted U-shape with open ends of said inverted U-shape being integrally formed with said first side portion of said body portion, so that said second handle extends outwardly from said side of said body portion.

4. The stackable container for storing and dispensing liquids according to claim 1, wherein said second handle has an aperture located between said second handle and said first side portion of said body portion enabling a person to wrap their fingers around said second handle for obtaining a sufficient grip of said second handle.

5. The stackable container for storing and dispensing liquids according to claim 1, wherein said body portion is of a shape having bilateral symmetry for assisting the internal pressure of said container, resulting from a liquid held in said container, to be evenly distributed throughout said container, when said container is full of the liquid, for providing compressive strength and stability to said container.

6. The stackable container for storing and dispensing liquids according to claim 1, wherein said neck portion includes a base integrally formed with said first side portion of said body portion.

7. The stackable container for storing and dispensing liquids according to claim 1, wherein said dispensing means is in the form of a spigot capable of sealing said container, when said container is to be in a closed position.

8. The stackable container for storing and dispensing liquids according to claim 7, wherein said spigot has a connection portion connectable to a neck portion of said container, said neck portion being attached to said body portion, said connection portion having a fluid passageway for dispensing liquid from said container.

9. The stackable container for storing and dispensing liquids according to claim 7, wherein said spigot includes a valve for controlling rate of liquid flow from said container.

10. The stackable container for storing and dispensing liquids according to claim 8, wherein said neck portion is capable of receiving liquid for allowing filling of said container of up to 99.5% of volume of said container.

11. The stackable container for storing and dispensing liquids according to claim 1, wherein said container, which the exception of said dispensing means, is a single, integral unit.

12. The stackable container for storing and dispensing liquids according to claim 1 which includes two of said outwardly closed protrusions along said line of symmetry.

13. The stackable container for storing and dispensing liquids according to claim 12, wherein said two said protrusions are integrally formed with said top portion and in fluid communication with said hollow interior for enabling liquid to be received therein, thereby providing internal hydraulic pressure and strength to said two said protrusions.

14. The stackable container for storing and dispensing liquids according to claim 12, wherein said protrusions are disposed on opposite sides of said first handle.

15. The stackable container for storing and dispensing liquids according to claim 12, which includes two of said outwardly closed recessed portions.

16. The stackable container for storing and dispensing liquids according to claim 1, wherein said support formation provided by said at least one protrusion located along a line of symmetry with said first handle provides stability in substantially two opposite directions, so that when said container is substantially filled and stacked, said container acquires a substantially symmetrical bulging shape extending from said line of symmetry.

* * * * *